United States Patent [19]

Lousberg

[11] Patent Number: 4,617,791

[45] Date of Patent: Oct. 21, 1986

[54] APPARATUS FOR MONITORING AND RESTARTING THE CUT YARN DURING THE REPLACEMENT OF FULL BOBBINS ON THE SPINDLES OF A CONTINUOUS SPINNING MACHINE

[75] Inventor: Pierre Lousberg, Stembert, Belgium

[73] Assignee: Societe Anonyme des Ateliers Houget Duesberg Bosson, Belgium

[21] Appl. No.: 657,629

[22] Filed: Oct. 4, 1984

[30] Foreign Application Priority Data

Oct. 5, 1983 [BE] Belgium ..... 211650

[51] Int. Cl.[4] ..... D01H 1/38; D01H 1/40

[52] U.S. Cl. ..... 57/299; 57/278; 57/303; 242/18 PW

[58] Field of Search ..... 57/299, 276–278, 57/300, 303; 242/18 PW, 18 EW

[56] References Cited

U.S. PATENT DOCUMENTS

| | | | |
|---|---|---|---|
| 2,258,166 | 10/1941 | Schoeller | 57/131 |
| 2,661,589 | 12/1953 | Haythornthwaite | 57/276 |
| 2,747,359 | 5/1956 | Keefe, Jr. | 57/299 |
| 2,881,583 | 4/1959 | Zuidema | 57/299 |
| 2,909,026 | 10/1959 | Bakker | 57/299 |
| 2,942,403 | 6/1960 | Elliott et al. | 57/299 |
| 3,122,874 | 3/1964 | Tessmer et al. | 57/299 |
| 3,210,922 | 10/1965 | Winter | 57/303 X |
| 3,283,489 | 11/1966 | Bakker | 57/303 X |
| 3,339,356 | 9/1967 | Nikel et al. | 57/299 |
| 3,490,218 | 1/1970 | Naegeli | 57/303 |
| 3,530,657 | 9/1970 | Grau | 57/303 |
| 3,768,242 | 10/1973 | Angst et al. | 57/303 |
| 4,050,227 | 9/1977 | Berend | 57/303 |
| 4,283,909 | 8/1981 | Keller | 57/306 |

FOREIGN PATENT DOCUMENTS

| | | |
|---|---|---|
| 1760458 | 2/1972 | Fed. Rep. of Germany . |
| 2461621 | 7/1975 | Fed. Rep. of Germany . |
| 2165041 | 4/1976 | Fed. Rep. of Germany . |
| 2444702 | 7/1976 | Fed. Rep. of Germany . |
| 2931209 | 2/1980 | Fed. Rep. of Germany . |
| 3202888 | 9/1982 | Fed. Rep. of Germany . |
| 3218880 | 1/1983 | Fed. Rep. of Germany . |
| 2461623 | 10/1983 | Fed. Rep. of Germany . |
| 2358962 | 2/1978 | France . |
| 288368 | 5/1953 | Switzerland . |
| 292640 | 11/1953 | Switzerland . |

*Primary Examiner*—John Petrakes

[57] ABSTRACT

In spinning machine comprising an underwinding device for winding the last turns, means are provided whereby the last yarn turns are cut positively on the intervention of the underwinding device and means are provided whereby the yarn end originating from the traveller is positively retained by the device to allow starting of the next winding operation at reduced speed, and this end is then released as soon as the spindle assumes its normal operating speed.

5 Claims, 10 Drawing Figures

FIG. 1
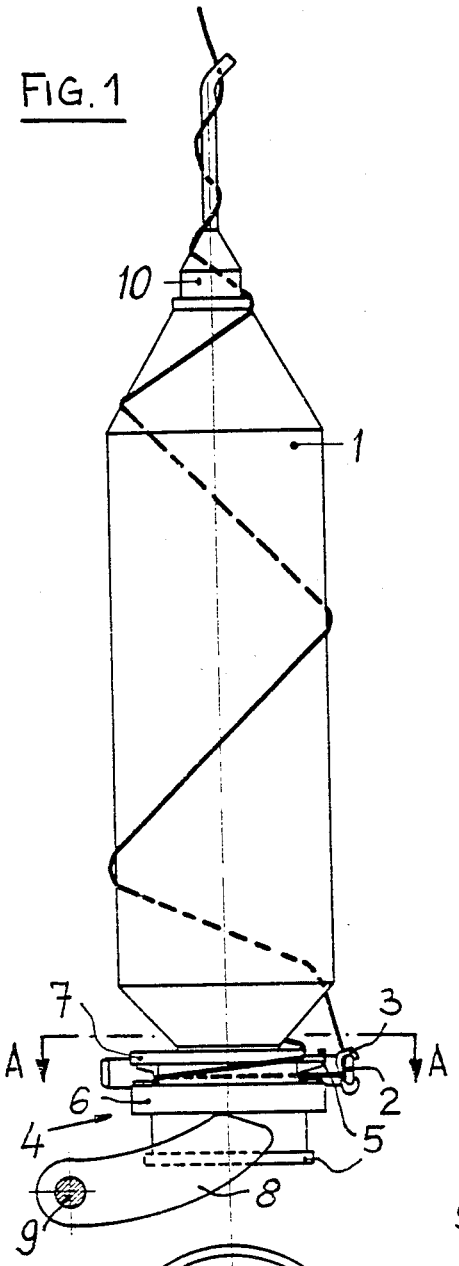
FIG. 2
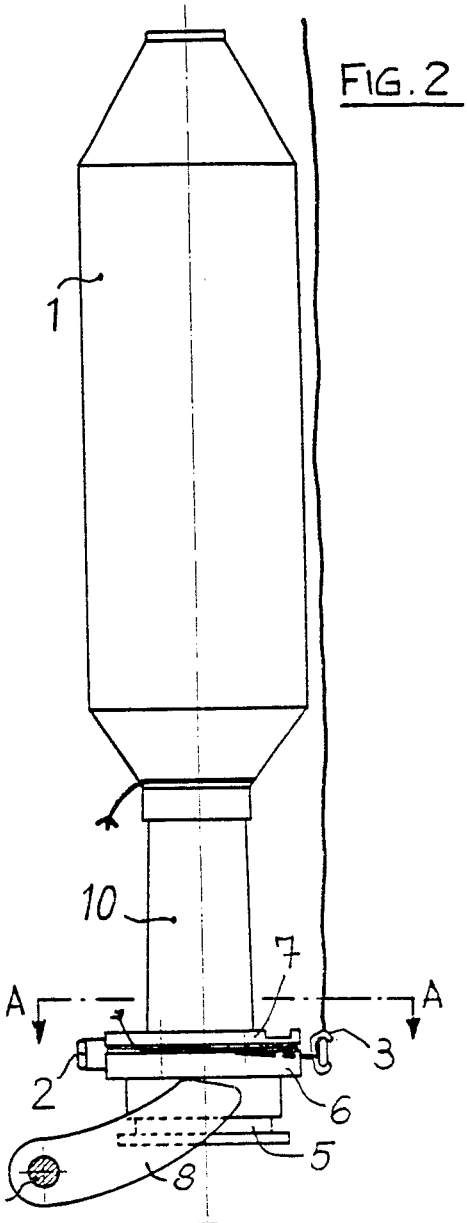
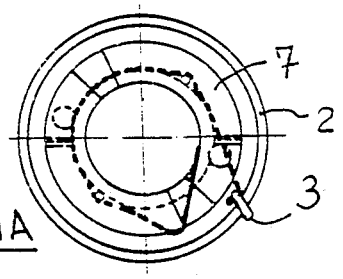
FIG. 1A
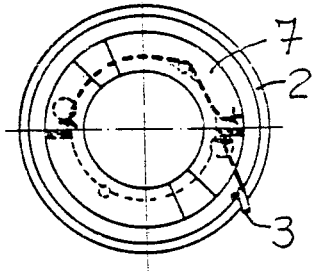
FIG. 2A

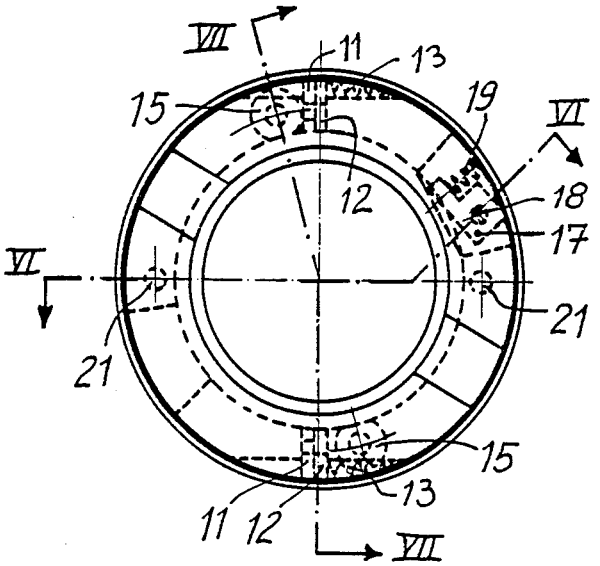
FIG. 5
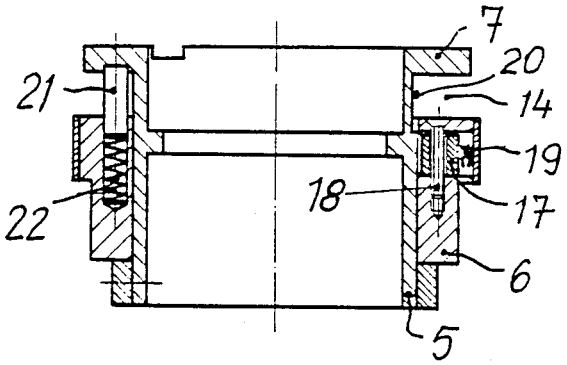
FIG. 6
FIG. 7
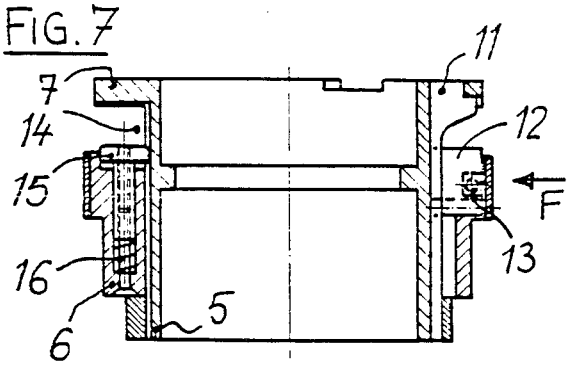
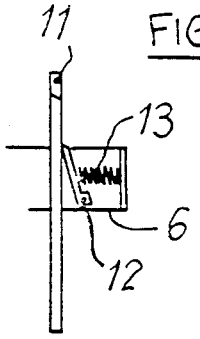
FIG. 8

APPARATUS FOR MONITORING AND RESTARTING THE CUT YARN DURING THE REPLACEMENT OF FULL BOBBINS ON THE SPINDLES OF A CONTINUOUS SPINNING MACHINE

This invention relates to spinning machines of the continuous type and relates to a method of and apparatus for monitoring and restarting the cut yarn during the replacement of full bobbins on the spindle of a continuous spinning machine by empty tubes.

The operation of a continuous spinning machine will be assumed to be known and such machines comprise a series of components which always comprise the following:

(a) A rotating vertical spindle on which a cardboard or plastic tube is placed, the yarn being wound thereon.

(b) A ring on which a traveller slides and which moves along the tube with a reciprocating movement to distribute the yarn turns over the entire length of the tube.

The yarn originating from doffing cylinders passes through the traveller and is wound on the tube.

When the tube has a sufficient yarn covering the result is a bobbin which has to be removed from the spindle, which is then stopped, and placed on a peg provided for the purpose, or a skip truck. Another tube then has to be placed on the spindle to form another bobbin.

Removal of the bobbin and the fitting of the tube were initially carried out manually.

Automatic devices were then introduced to reduce handling times and avoid heavy and repetitive work.

The object of this invention is basically further to automate operations for replacing full bobbins by empty tubes on a machine having a given number of spindles.

When the bobbins are fully wound the position is as follows:

(a) The full bobbin is situated vertically on the spindle.

(b) An empty tube is situated vertically on a replacement tube peg which is in turn some distance in front of the spindle and possibly slightly offset therefrom, and hence in fact situated between the spindle in question and the next spindle.

In practice, the problem underlying the invention is to ensure effective monitoring of the yarn during the above replacement operation, so that the actual winding process can restart automatically on the empty tube.

This procedure requires various operations including removal of the full bobbin and the fitting of the empty tube. These operations do not of themselves form part of the invention.

This invention is concerned more particularly with the following operations:

(a) Cutting the yarn (b) Monitoring or controlling the yarn.

When the bobbin is fully wound, the ring on which the traveller slides moves downwards and the last turns of the yarn are wound at the bottom of the bobbin. When the bobbin is to be removed without manual intervention, these last turns are wound on a special device situated beneath the bottom of the bobbin tube, this device being known as an underwinding device.

The strength of the yarn is often such that a considerable force is required to break it, so that it has to be cut positively.

The method used for cutting the yarn forms part of this invention.

When the yarn has been cut, there are two yarn ends:

(a) One originating from the full bobbin, this end being removed with the full bobbin.

(b) The other originates from the traveller and must be kept connected to the spindle so as to allow winding to restart when the full bobbin has been replaced by the empty tube. This end must be driven by the spindle on restarting of the latter so that the traveller may be re-driven by the stretched yarn and the winding process can restart.

In the manual process, this yarn end is clamped between the spindle and the empty tube by the operative.

The method used to hold this yarn without the intervention of the operative forms part of this invention.

To achieve these objects, the invention consists essentially in that means are provided whereby the last turns of yarn are cut positively on intervention by the underwinding device and means are provided whereby the yarn end originating from the traveller is positively retained by the device to allow the next winding operation to start at reduced speed, and said end is then released as soon as the spindle assumes its normal operating speed.

In order that the invention may be more readily understood, one exemplified embodiment will now be described without limiting force and with reference to the accompanying drawings wherein:

FIGS. 1 and 2 are elevations of a spindle with a full bobbin having an underwinding device, and show the operation of the device.

FIGS. 1A and 2A are sections on A—A respectively in FIGS. 1 and 2.

FIG. 5 is a plan view of the underwinding device.

FIG. 6 is a section on the line VI—VI in FIG. 5.

FIG. 7 is a section on the line VII—VII in FIG. 5.

FIG. 8 is an elevation of the cutting device looking in the direction of arrow F in FIG. 7.

FIG. 1 illustrates the full bobbin 1, the ring 2 and the traveller 3, which is movable on the ring.

FIG. 1 shows the situation in which winding is completed and the bobbin 1 is full, the ring 2 and the traveller 3 having consequently gone to their lowest position so as to allow the bobbin to be disengaged and removed.

During the downward movement of the ring and the traveller, the last turns of the winding are wound around the bobbin and around an underwinding device 4 situated beneath the bobbin.

Figure 3:
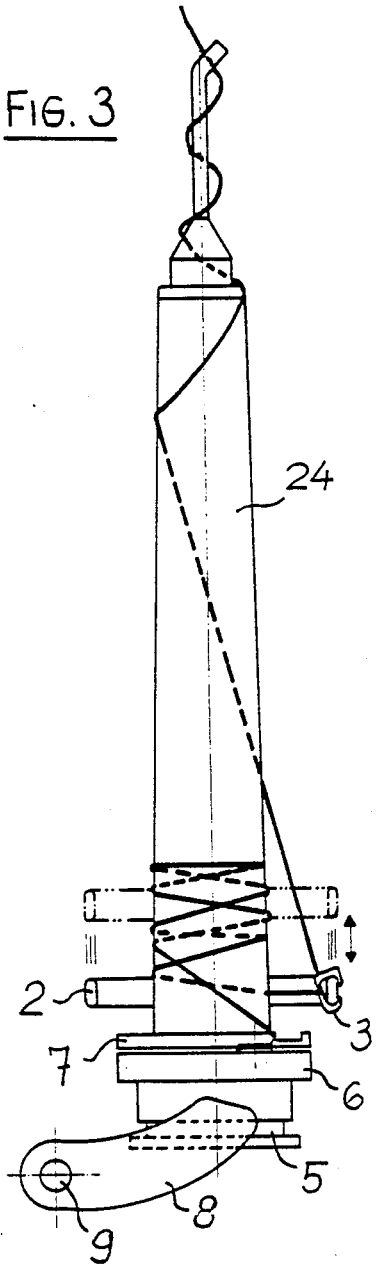
FIGS. 3 and 4 are elevations corresponding to FIGS. 1 and 2 showing operation with an empty tube.
Figure 4:
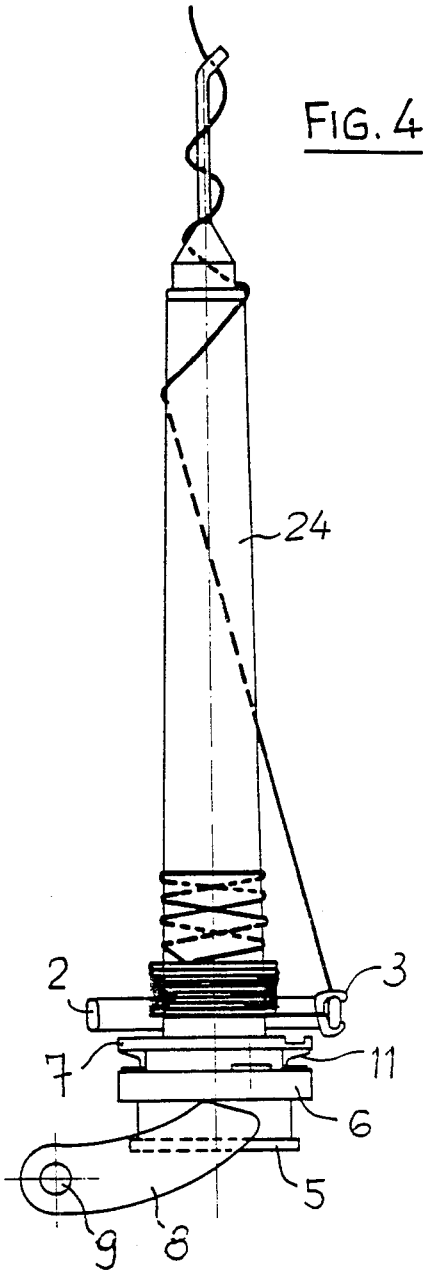

Device 4 consists principally of two rings 5–6, one of which, 5 (FIGS. 1–4 and 5–7) can move along the spindle 10 while the other, 6, is also movable in that it can slide downwardly on ring 5.

When the outer ring 6 is in the bottom position, the ring together with a shoulder 7 provided at the top of the inner ring 5 defines a groove 14 in which the last turns of the yarn are wound before the bobbin is stopped (end of the rotation).

Pivots 9 are provided on each side of the ring 5 and on each of them there is articulated a lever 8 (FIGS. 1 to 4). During their rotation about the pivot 9, the levers 8 abut the bottom surface of the outer ring 6 so that the latter is then lifted by the levers 8 and moves upwardly along the inner ring 5.

The inner ring 5 has a vertical knife blade 11 in diametrically opposite positions (FIGS. 7 and 8); the outer ring 6 also has a knife blade 12 in diametrically opposite positions, the latter blade acting by bearing on the blade 11 by means of a spring 13.

During the upward movement of the outer ring 6, the cutting parts of the knives 11 and 12 come into contact and cut the turns of yarn wound in the groove 14 situated between the shoulder 7 of ring 5 and the ring 6.

The outer ring 6 has two push members 15 in diametrically opposite positions.

During the upward movement of the outer ring 6, members 15 encounter the shoulder 7 of the inner ring and act on the turns of the yarn, which are thus clamped.

The push members 15 are, however, disposed exactly beside the blades 11 and 12 in such a manner that the end of the yarn which is clamped and retained is the yarn end originating from the traveller 3. Consequently, the yarn end originating from the full bobbin is itself free, so that the bobbin can be removed. The members 15 are biased by springs 16 to give effective yarn clamping.

The outer ring 6 has a pawl 17 pivotally mounted on a pivot 18 and pushed towards the centre of the spindle by a spring 19.

During the upward movement of the outer ring 6, pawl 17 slides on the wall of the inner ring 5 and then engages, in response to the action of a spring 19, in a groove 20 formed in the inner ring 5.

Consequently, the outer ring 6 is no longer free to move downwards by itself. An external action is required to release the pawl 17 from the groove 20.

After the spindle has been stopped, an external action will be produced on restarting of the spindle, as a result of the centrifugal force which will act on the pawl 17 and force it to disengage from the groove 20, so that the outer ring 6 can move downwards, thus freeing the yarn.

The outer ring 6 has two lugs 21 engaging in holes and biased by springs 22 against the shoulder 7 of the inner ring 5.

The object of these lugs 21 is to push the outer ring 6 downwards positively as soon as the pawl 17 is disengaged from the groove 20.

The complete process for the removal of a full bobbin and the positioning of an empty tube is then as follows:

1. The bobbin being complete, the ring 2 and the traveller 3 move downwards and wind one or two turns in the groove 14.

2. The levers 8 lift the outer ring 6.

3. As a result of this movement the knives and 12 cut these yarn turns.

4. At that moment, the end of the yarn originating from the traveller 3 is clamped by one of the push members 15.

5. The yarn end originating from the bobbin is free and allows the bobbin to be removed.

6. As a result of the same movement of levers 8, pawl 17 engages in groove 20 thus preventing the ring 6 from moving down again.

7. Bobbin 1 is replaced by an empty tube 24.

8. The levers 8 move down again.

9. The ring 2 and the traveller 3 rise slightly so as to be situated opposite the bottom surface of the tube 24.

10. The spindle starts at slow speed and a few turns of yarn are wound on the bottom of the tube 24. The speed is slow enough to prevent the pawl 17 from disengaging from the groove 20 by centrifugal force.

11. As soon as a few turns have been wound and clamp the yarn end originating from the traveller, the winding proper can start and the spindle speed is increased.

12. The pawl 17 disengages from the groove 20 by centrifugal force. The yarn end originating from the traveller is then released, but remains engaged by the first turns of the yarn.

13. The outer ring 6 is then pushed downwards by the action of the springs 22 and lugs 21.

14. The device is then ready for the next operation of the same type.

The combination of the various movements and the sequences of operations are provided by electrical and pneumatic means controlled by an electronic programmer.

I claim:

1. In a continous spinning machine, an apparatus for monitoring and restarting a cut yarn when a full bobbin is replaced by an empty tube comprising an underwinding device for winding the last yarn turns on the full bobbin and around said device with the aid of a traveller, said underwinding device comprising an inner ring and an outer ring, the outer ring being slidable on the inner ring, each ring being provided with at least one knife blade, said blades being arranged vertically in such manner whereby upon sliding of said outer ring upon said inner ring said blades can bome into contact with said last yarn wound around said underwinding device and cut them, and means for positively retaining the yarn end originating from the traveller to allow starting of the next winding operation.

2. An apparatus according to claim 1, wherein there are a plurality of pairs of knife blades provied on said underwinding device, each arranged in a plane containing the axis of the spindle, whereby all the yarn turns wound on the underwinding device are cut when the outer ring slides on the inner ring.

3. An apparatus according to claim 1 or 2, wherein the outer ring is provided with push members so disposed that upon sliding movement of said outer ring on said inner ring the yarn end originating from the traveller is positively clamped between said outer ring and inner ring while still being connected to the spindle, whereas the yarn end originating from the full bobbin is free.

4. An apparatus according to claim 3, wherein a pawl is provided on said underwinding device to prevent the outer ring from moving away from a clamping position with said inner ring in order to allow rottion of the spindle at a sped less than normal operating speed.

5. An apparatus according to claim 4, wherein said pawl is movable to a released position in response to centrifugal force to allow the outer ring to move out of the clamping position with said inner ring as soon as the spindle assumes its normal pg,14 operating speed, and lugs are provided to force the outer ring to move out of clamping position with said inner ring.

* * * * *